US009623574B2

(12) United States Patent
Krause

(10) Patent No.: US 9,623,574 B2
(45) Date of Patent: Apr. 18, 2017

(54) CUTTING-ASSEMBLY MOUNT

(75) Inventor: Roberto Krause, Villingen-Schwenningen (DE)

(73) Assignee: WAHL GmbH, Unterkirnach (DE)

( * ) Notice: Subject to any disclaimer, the term of this patent is extended or adjusted under 35 U.S.C. 154(b) by 761 days.

(21) Appl. No.: 13/477,258

(22) Filed: May 22, 2012

(65) Prior Publication Data

US 2012/0297630 A1 Nov. 29, 2012

(30) Foreign Application Priority Data

May 27, 2011 (DE) ..... 10 2011 076 577

(51) Int. Cl.
*B26B 19/06* (2006.01)
*B26B 19/24* (2006.01)
*B26B 19/38* (2006.01)

(52) U.S. Cl.
CPC ..... *B26B 19/06* (2013.01); *B26B 19/24* (2013.01); *B26B 19/3846* (2013.01)

(58) Field of Classification Search
CPC ..... B25D 51/08; B25D 51/10; B26B 19/06; B26B 19/3846; B26B 19/24
USPC ..... 30/329–337, 194, 392; 74/527, 232; 150/149; 16/348, 352, 351, 326, 327, 16/321, 258; 403/325
See application file for complete search history.

(56) References Cited

U.S. PATENT DOCUMENTS 83,967 A * 11/1868 Horel ..... 292/288
324,444 A * 8/1885 Wolf ..... 16/322
661,845 A * 11/1900 Brye ..... 403/325
1,830,077 A * 11/1931 Seaver ..... 24/434
2,182,597 A * 12/1939 Oster ..... 30/210
3,222,781 A * 12/1965 Ulke et al. ..... 30/210
4,765,060 A 8/1988 Veselaski et al.
4,987,640 A * 1/1991 Lin ..... 16/327
5,700,125 A * 12/1997 Falace et al. ..... 414/276
6,112,420 A * 9/2000 Schickerling ..... 30/392
6,478,285 B1 * 11/2002 Bergmann ..... 251/129.03
6,941,617 B2 * 9/2005 Pinto ..... 16/297
7,147,191 B2 * 12/2006 Ichikawa et al. ..... 248/292.12
2004/0045172 A1 * 3/2004 Rowlay ..... 30/162
2005/0007728 A1 * 1/2005 Takahashi et al. ..... 361/600
2014/0183907 A1 * 7/2014 Tanner et al. ..... 296/193.11

FOREIGN PATENT DOCUMENTS

CN 86 201 352 U 7/1987
DE 607 692 C 1/1935

* cited by examiner

*Primary Examiner* — Stephen Choi
*Assistant Examiner* — Fernando Ayala
(74) *Attorney, Agent, or Firm* — Muirhead and Saturnelli, LLC

(57) ABSTRACT

A cutting-assembly mount for hair clippers includes an accommodating base, which can be fastened on the hair clippers, and an accommodating limb, which is mounted on the accommodating base and on which an interchangeable cutting assembly can be arranged. A blocking element is provided which can be moved between a pivoting position and a blocking position and is designed to be suitable for blocking a pivoting movement of the accommodating limb in the direction of the accommodating base without any cutting assembly arranged on the accommodating limb.

20 Claims, 3 Drawing Sheets

CUTTING-ASSEMBLY MOUNT

TECHNICAL FIELD

This application relates to a cutting-assembly mount for hair clippers.

BACKGROUND OF THE INVENTION

A corresponding cutting-assembly mount for hair clippers has an accommodating base, which can be fastened on the hair clippers, and an accommodating limb, which is mounted in a pivotable manner on the accommodating base, wherein an interchangeable cutting assembly can be arranged on the accommodating limb. Such cutting-assembly mounts are used typically for hair clippers used predominantly in the care of animals, and serve for accommodating an interchangeable cutting assembly which can be arranged on the hair clippers. The cutting-assembly mounts are designed, for this purpose, in the form of a swing-action mechanism, wherein the cutting assembly can be arranged on the accommodating limb of the cutting-assembly mount, e.g. it can be pushed onto the same, and then, together with the accommodating limb, can be swung onto the hair clippers in the direction of the accommodating base and fixed there, for example by latching.

In the case of the known cutting-assembly mounts, such latching takes place even when the cutting-assembly mount is accidentally swung closed without the cutting assembly inserted, i.e. when the accommodating limb is pivoted in the direction of the accommodating base, and latched there, without any cutting assembly arranged thereon. If swung closed without any cutting assembly arranged thereon, the prior-art cutting-assembly mounts can be opened again only with the aid of a tool and thus have the disadvantage that any further use of the hair clippers is not possible if there is no suitable tool available or handling thereof is mismanaged. Furthermore, mismanagement of the appropriate tool gives rise to an increased risk of injury.

Accordingly it would be desirable to eliminate the aforementioned problems.

SUMMARY OF THE INVENTION

A cutting-assembly mount according to the system described herein for hair clippers has an accommodating base, which can be fastened on the hair clippers, and an accommodating limb, which is mounted in a pivotable manner on the accommodating base and on which an interchangeable cutting assembly can be arranged, there being provided, on the cutting-assembly mount, a blocking element, which can be moved between a pivoting position and a blocking position and is designed to be suitable for blocking a pivoting movement of the accommodating limb in the direction of the accommodating base without any cutting assembly arranged on the accommodating limb.

The configuration according to the system described herein has the advantage that an appropriately configured blocking element prevents the cutting-assembly mount, without any cutting assembly arranged thereon, from accidentally swinging closed, and thus makes it possible to avoid the use of an appropriate tool for opening the cutting-assembly mount. The risks of injury mentioned and the necessity to provide an appropriate tool are thus avoided.

Particularly favorable handling is achieved if the blocking element is suitably designed to be capable of being transferred into the pivoting position by the cutting assembly as the latter is being arranged on the accommodating limb.

As a result, the blocking element is transferred by, for example, the cutting assembly being plugged onto the accommodating limb. Swing action can thus be released without any additional manipulation, whereas, without any cutting assembly arranged on the accommodating limb, the pivoting movement is blocked. In comparison with a configuration in which the blocking element is transferred into the pivoting position manually, for example via an unlocking lever, this has the advantage that accidental swing action of the cutting-assembly mount without any cutting assembly arranged thereon is not possible.

The blocking element may be mounted, for example, on a pivot pin of the cutting-assembly mount.

A particularly reliable configuration can be achieved if the blocking element is spring-loaded in the direction of the blocking position.

Spring-loading of the blocking element in the direction of the blocking position provides that the blocking element, without any force acting thereon, is always transferred into the blocking position. It is only if the blocking element is subjected to force, for example by the cutting assembly being pushed onto the accommodating limb, that it is transferred out of the blocking position into the pivoting position, and swing action of the accommodating limb, with the cutting assembly arranged thereon, onto the accommodating base is thus released.

The blocking element may be designed, for example, as a blocking catch.

Such a blocking catch may be mounted in a displaceable manner on the cutting-assembly mount, for example such that it can be displaced parallel to the accommodating limb.

If the blocking catch is mounted such that it can be displaced parallel to the accommodating limb, this makes it possible for the blocking catch to be transferred into the pivoting position by the cutting assembly being pushed onto the accommodating limb. Since the movement of the cutting assembly being pushed onto the accommodating limb is executed usually parallel to the accommodating limb, this linear movement can be transmitted directly to the blocking catch, and any change in the movement direction and associated risks of jamming are thus avoided.

The blocking catch may be designed, for example, such that, in the blocking position, a blocking step of the blocking catch runs up against the accommodating base and thus blocks a pivoting movement of the accommodating limb. The accommodating base preferably has a recess for accommodating the blocking catch in the pivoting position.

As an alternative to a configuration of the blocking element as a blocking catch, the blocking element may also be designed as something of an angled blocking element.

Such an angled blocking element may be mounted such that it can be displaced, for example, parallel to the pivot pin.

An angled blocking element mounted such that it can be displaced parallel to the pivot pin may have, for example, a run-up edge which runs obliquely in the pushing-on direction of the cutting assembly and by which a pushing-on movement oriented in the direction of the pivot pin is converted into a movement of the angled blocking element oriented parallel to the pivot pin, and therefore this angled blocking element can be transferred into the pivoting position by the cutting assembly being pushed on.

As an alternative, the angled blocking element may be mounted in a pivotable manner on the cutting-assembly mount.

Spring-loading of the blocking element in the direction of the blocking position also makes it possible to achieve the situation where a cutting assembly, in the open state of the cutting-assembly mount, is detached, as it were, automatically from the accommodating limb and thus ejected more or less automatically.

The operations of the cutting-assembly mount being opened automatically and of the cutting assembly being ejected automatically can be assisted by the accommodating limb being of spring-loaded configuration in the opening direction.

If, in the case of such a configuration, a locking device of the cutting-assembly mount is opened, then the accommodating limb swings down automatically from the accommodating base, wherein, in the case of the blocking element being of spring-loaded configuration, appropriate dimensioning of the spring also makes it possible for the cutting assembly to be ejected automatically.

In principle, however, it is not imperative for the cutting assembly to be ejected, since a strong spring would be necessary for this purpose, and this would make it difficult for the cutting assembly to be plugged on again. Ideally, the spring force is large enough in order to move the blocking element reliably into the blocking position, but small enough in order to be moved out of the blocking position again by the gravitational force of a cutting assembly placed in position vertically. There should therefore be no need for the user to apply any additional force, for the purpose of moving the blocking element, if he is placing the cutting assembly in position vertically.

Hair clippers may be equipped directly with a cutting-assembly mount having the features described above. Such hair clippers are used preferably in the care of animals.

BRIEF DESCRIPTION OF THE DRAWINGS

Embodiments of the system described herein will be explained in detail hereinbelow with reference to the accompanying Figures, in which.

DETAILED DESCRIPTION OF VARIOUS EMBODIMENTS

Figure 1:
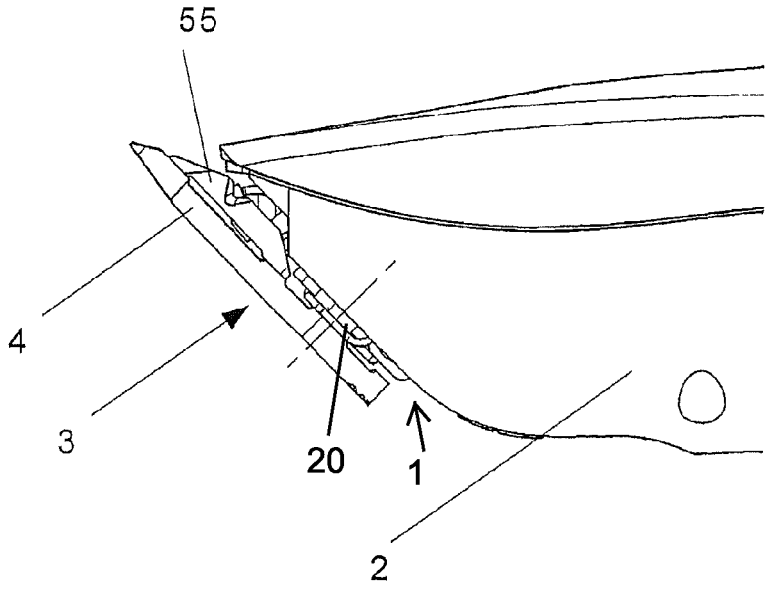
FIG. 1 shows a side view of hair clippers according to an embodiment of the system described herein.

FIG. 1 shows a side view of hair clippers having a housing 2, on the front side of which is arranged a cutting assembly 3 comprising a clipping comb 4 and a clipping blade 5, which is arranged above the latter such that it can be driven in oscillation. An oscillating movement of the clipping blade 5 can be generated by a hair-clippers drive arranged in the housing 2.

Figure 2:
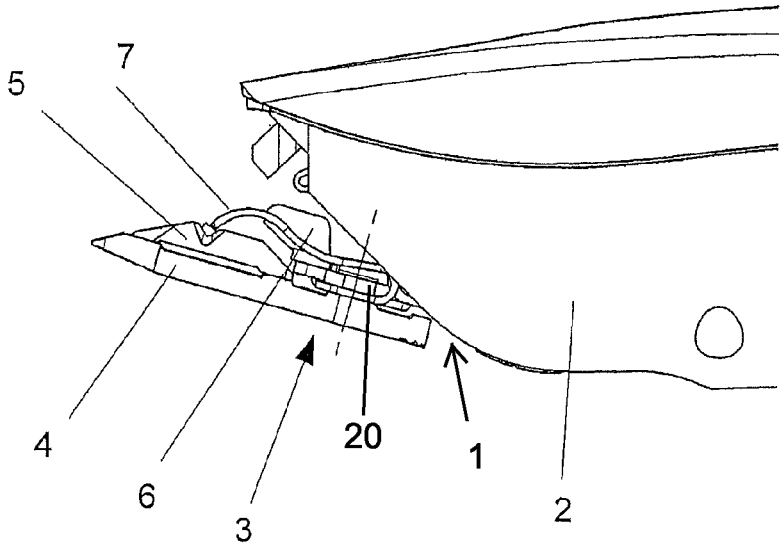
FIG. 2 shows the hair clippers from FIG. 1 with the cutting assembly swung down.

FIG. 2 shows the hair clippers from FIG. 1 with the cutting assembly 3 swung down.

This illustration shows the construction of the cutting assembly 3 to particularly good effect. A cutting compression spring 7, which is arranged on the clipping comb 4, subjects the clipping blade 5 to a contact pressure, which prevents hair from jamming between teeth arranged on the front side of the clipping comb 4 and the clipping blade 5, which would result in the cutting assembly 3 blocking. An oscillation movement of the drive is transmitted to the clipping blade 5 via a driver 6. The driver 6 is arranged on the drive side of the clipping blade 5 and has an engagement device for a stub which is arranged on the front side of the drive and is intended for transmitting the oscillation movement.

Figure 3:
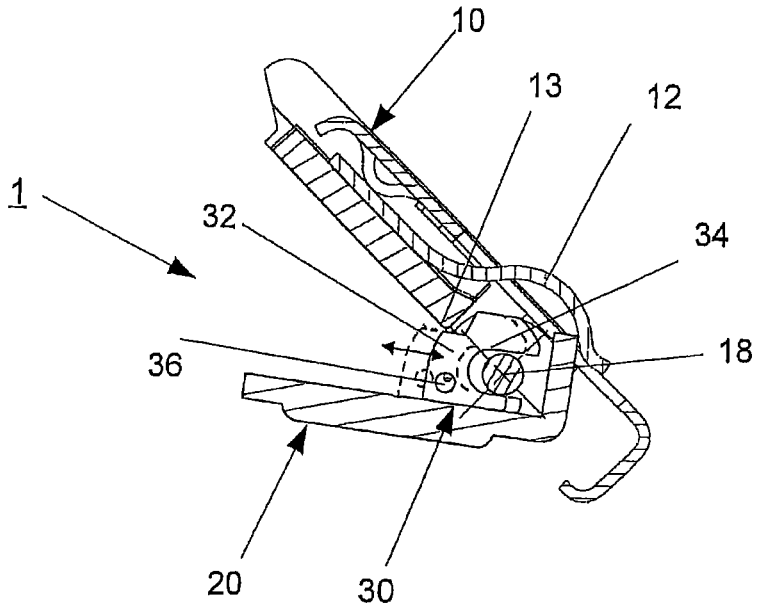
FIG. 3 shows a sectional side view of a cutting-assembly mount according to an embodiment of the system described herein.

FIG. 3 illustrates a cutting-assembly mount 1 as is used on the front side of the hair clippers from FIGS. 1 and 2. FIG. 3 shows a sectional illustration of the cutting-assembly mount 1, and this allows the construction of the latter to be shown to particularly good effect.

The cutting-assembly mount 1 is formed essentially from an accommodating base 10, on which an accommodating limb 20 is arranged in a pivotable manner. The accommodating limb 20 is of essentially L-shaped design in side view and is mounted on the accommodating base 10 such that it can be pivoted via a pivot pin 18. Also mounted on the pivot pin 18 is a blocking element 30, the latter such that it can be displaced parallel to the accommodating limb 20. The blocking element 30 has a U-shaped guide 34, by which it engages over the pivot pin 18 and can thus be displaced along the accommodating limb 20. The accommodating limb 20 is subjected, on its rear side, to the action of a leaf spring 12, which is arranged on the accommodating base 10 and is of arcuate configuration such that a rear portion of the accommodating limb 20 slides into the arc and thus, as a result of the spring-loading, causes the accommodating limb 20 to open, i.e. swing down. On its side which is directed toward the accommodating limb 20, oriented in the direction of the pivot pin 18, the accommodating base 10 has a stop edge 13, against which the blocking element 30, which in the present example is designed as a blocking catch 30, strikes in the blocking position and can thus block the cutting-assembly mount 1 from swinging closed. For this purpose, the blocking catch 30 has a blocking step 32 which, when the blocking catch 30 is located in the blocking position, strikes against the stop edge 13.

The blocking catch 30 is illustrated in two different positions in FIG. 3, wherein a position in which it is disengaged in the frontward direction (illustrated by dashed lines) constitutes the blocking position of the blocking catch 32. That position of the blocking catch 30 which is illustrated by solid lines constitutes an intermediate position, in which the blocking catch 30 has been displaced in the direction of the pivoting position. The pivoting position is reached as soon as a front edge of the blocking step 32 can slide past the stop edge 13.

Spring-loading of the blocking catch 30 is achieved by a compression spring which engages in the engagement opening 36 and thus loads the blocking catch 30 in the frontward direction. Such a compression spring may be supported, for example, in the rearward direction, on the L-shaped accommodating limb 20 or on the pivot pin 18.

Figure 4:
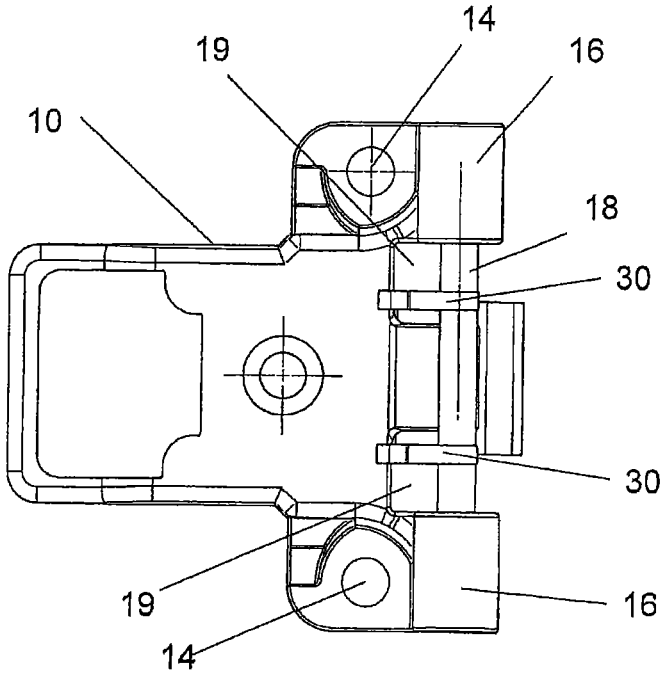
FIG. 4 shows a plan view of the cutting-assembly mount from FIG. 3.

FIG. 4 shows a plan view of the cutting-assembly mount 1 from FIG. 3. It is only the accommodating base 10 with the pivot pin 18 arranged thereon which is illustrated, the accommodating limb 20 having been omitted in order to give a better view of the blocking mechanism.

This plan view shows that the present exemplary embodiment has two blocking catches 30, which are spaced apart from one another on the pivot pin 18. This makes it possible to achieve uniform distribution of force over the accommodating base for the case where, despite the blocking catch 30 being located in the blocking position, an attempt is made to swing the cutting-assembly mount closed. Furthermore, the cutting-assembly mount 1 is prevented from being swung closed if the cutting assembly 3 is inserted in a skewed state, and therefore incorrect operation, in this way, is ruled out.

The blocking catches 30 are illustrated in the blocking position in FIG. 4. This is evident in that a front edge of the blocking catches 30 overlaps with the stop edge 13 of the accommodating base 10 and thus strikes against the same. In order to accommodate the blocking catches 30 in the pivoting position, the accommodating base 10 has two recesses 19, into which the blocking catches 30 can penetrate when they are pushed in the direction of the pivot pin 18 by the cutting assembly 3, and therefore a pivoting movement of the accommodating limb 20 is released.

The pivot pin 18 is retained on the outside of the accommodating base 10 via two bearing bushings 16, which in the present exemplary embodiment are formed in one piece on the accommodating base 10.

The accommodating base 10 also has two fastening bores 14, by way of which the accommodating base 10 can be fastened on the hair clippers by two screws.

Figure 5:
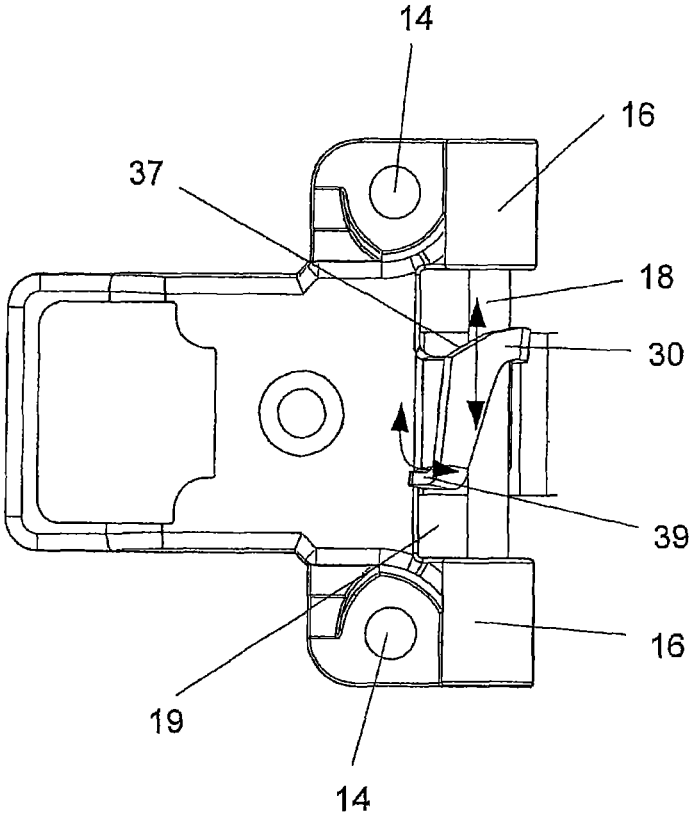
FIG. 5 shows a plan view of the second configuration of a cutting-assembly mount according to an embodiment of the system described herein.

FIG. 5 shows a second exemplary embodiment of a cutting-assembly mount 1 according to the system described herein. The cutting-assembly mount 1 according to FIG. 5 differs from the cutting-assembly mount 1 according to FIG. 4 in that the blocking element 30, rather than being designed as a blocking catch, is designed as something of an angled blocking element 30. A corresponding angled blocking element 30 has a blocking nose 39 which, in the blocking position of the angled blocking element, strikes against the accommodating base 10 and thus blocks a pivoting movement of the accommodating limb 20 in the direction of the accommodating base 10. As is illustrated in FIG. 5, such an angled blocking element 30, depending on how it is mounted, can be transferred from the blocking position into the pivoting position in two ways.

In a first variant, the angled blocking element 30 is mounted on the pivoting pin 18 and is designed such that it can be displaced along the pin 18. In order for the angled blocking element 30 to be transferred from the blocking position into the pivoting position, a run-up edge 37 is provided, this being designed such that it transfers a linear pushing-on movement of the cutting assembly 3 in the direction of the pivot pin 18 into a linear movement of the angled blocking element 30 parallel to the pivot pin 18. In this way, the blocking nose 39 is likewise displaced parallel to the pivot pin 18 and can thus be transferred from being positioned above the accommodating base 10 into a position in the region of one of the recesses 19. The blocking nose 39 is then arranged such that it penetrates into the recesses 19 and thus allows a pivoting movement of the accommodating limb 20 in the direction of the accommodating base 10.

In this embodiment, spring-loading of the angled blocking element 30 can be achieved particularly straightforwardly, for example, by a helical spring arranged on the pivot pin 18.

In a second embodiment, the angled blocking element 30 is mounted in a pivotable manner either on the accommodating base or on the accommodating limb and is pivoted, by virtue of the cutting assembly 3 being plugged on, into a position over the recess 19, and therefore, in this position too, a pivoting movement between the accommodating limb 20 and accommodating base 10 is released.

There is also, in principle, a series of further options which are intended for configuring a cutting-assembly mount 1 with a blocking element 30 and can be realized without deviating from the basic concept of the system described herein. In particular, a possible configuration of the accommodating base 10, accommodating limb 20 and blocking element is one in which the recess 19, rather than being provided in the accommodating base 10, is provided on the accommodating limb 20 or on the blocking element 30.

Various embodiments discussed herein may be combined with each other in appropriate combinations in connection with the system described herein. Additionally, in some instances, the order of steps in the flowcharts, flow diagrams and/or described flow processing may be modified, where appropriate.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A cutting-assembly mount for a hair clipper, comprising:

an accommodating base which can be fastened on the hair clipper, the accommodating base including a stop edge;

an accommodating limb which is mounted on the accommodating base and on which an interchangeable cutting assembly can be arranged; and a blocking element which is movable between a pivoting position and a blocking position and that blocks a pivoting movement of the accommodating limb in the direction of the accommodating base without the cutting assembly being arranged on the accommodating limb by striking the stop edge of the accommodating base, wherein the accommodating limb prevents the cutting-assembly mount, without any cutting assembly arranged thereon, from accidentally swinging closed.

2. The cutting-assembly mount according to claim 1, wherein the blocking element is transferrable into the blocking position when the cutting-assembly mount is in an open state in the absence of the cutting assembly.

3. The cutting-assembly mount according to claim 1, wherein the blocking element is mounted on a pivot pin of the cutting-assembly mount, the pivot pin being arranged between the accommodating base and accommodating limb.

4. The cutting-assembly mount according to claim 1, wherein the blocking element is spring-loaded in the direction of the blocking position.

5. The cutting-assembly mount according to claim 1, wherein the blocking element includes a blocking catch.

6. The cutting-assembly mount according to claim 5, wherein the blocking catch is mounted in a displaceable manner.

7. The cutting-assembly mount according to claim 6, wherein the blocking catch is mounted such that the blocking catch is displaceable parallel to the accommodating limb.

8. The cutting-assembly mount according to claim 5, wherein, when the blocking catch is in the blocking position, a blocking step runs up against the accommodating base.

9. The cutting-assembly mount according to claim 1, wherein the blocking element includes an angled blocking element.

10. The cutting-assembly mount according to claim 9, wherein the angled blocking element is mounted such that the angled blocking element is displaceable parallel to the pivot pin.

11. The cutting-assembly mount according to claim 9, wherein the angled blocking element is mounted in a rotatable manner.

12. The cutting-assembly mount according to claim 10, wherein the angled blocking element has a run-up edge which is arranged such that the angled blocking element, when the cutting assembly is being arranged in position, is transferred into the pivoting position.

13. The cutting-assembly mount according to claim 1, wherein the accommodating limb is spring-loaded in the opening direction.

14. The cutting-assembly mount according to claim 1, wherein the cutting-assembly mount has a recess in which the blocking element engages, at least in part, in the pivoting position.

15. A hair clipper, comprising:

a cutting-assembly mount, wherein the cutting-assembly mount includes:

an accommodating base having a stop edge;

an accommodating limb which is mounted on the accommodating base and on which an interchangeable cutting assembly can be arranged; and a blocking element which is movable between a pivoting position and a blocking position and that blocks a pivoting movement of the accommodating limb in the direction of the accommodating base without the cutting assembly being arranged on the accommodating limb by striking the stop edge of the accommodating base, wherein the accommodating limb prevents the cutting-assembly mount, without any cutting assembly arranged thereon, from accidentally swinging closed.

16. The hair clipper according to claim 15, wherein the blocking element is transferrable into the blocking position when the cutting-assembly mount is in an open state in the absence of the cutting assembly.

17. The hair clipper according to claim 15, wherein the blocking element is mounted on a pivot pin of the cutting-assembly mount, the pivot pin being arranged between the accommodating base and accommodating limb.

18. The hair clipper according to claim 15, wherein the blocking element is spring-loaded in the direction of the blocking position.

19. The hair clipper according to claim 15, wherein the blocking element includes at least one of: a blocking catch or an angled blocking element.

20. The cutting-assembly mount according to claim 19, wherein the blocking catch or the angled blocking element are mounted in a displaceable manner.

* * * * *